US006488597B2

(12) United States Patent
Iwami et al.

(10) Patent No.: US 6,488,597 B2
(45) **Date of Patent: *Dec. 3, 2002**

(54) GOLF BALL

(75) Inventors: Satoshi Iwami, Kobe (JP); Akira Kato, Kobe (JP); Keiji Moriyama, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/808,359

(22) Filed: Mar. 15, 2001

(65) Prior Publication Data

US 2001/0031670 A1 Oct. 18, 2001

(30) Foreign Application Priority Data

Mar. 15, 2000 (JP) ..... 2000-072928

(51) Int. Cl.[7] ..... A63B 37/12; A63B 37/14; A63B 37/06; A63B 37/04

(52) U.S. Cl. ..... 473/378; 473/377

(58) Field of Search ..... 473/351–378

(56) References Cited

U.S. PATENT DOCUMENTS

| | | | | |
|---|---|---|---|---|
| 4,884,814 A | | 12/1989 | Sullivan | |
| 5,120,791 A | | 6/1992 | Sullivan | |
| 5,274,041 A | * | 12/1993 | Yamada | 260/998.14 |
| 5,562,287 A | * | 10/1996 | Endo et al. | 273/377 |
| 5,716,293 A | | 2/1998 | Yabuki et al. | |
| 6,371,869 B1 | * | 4/2002 | Kato et al. | 473/356 |

FOREIGN PATENT DOCUMENTS

| | | |
|---|---|---|
| EP | B10557069 | 8/1993 |
| GB | A2311530 | 10/1997 |
| JP | A10179803 | 7/1998 |

* cited by examiner

*Primary Examiner*—Paul T. Sewell
*Assistant Examiner*—Alvin A. Hunter
(74) *Attorney, Agent, or Firm*—Birch, Stewart, Kolasch & Birch, LLP

(57) ABSTRACT

A golf ball is provided exhibiting soft feeling with a superior coefficient of restitution at low temperature, and that easily comes to a halt and has high spin maintenance even though exhibiting high spin rate when shot with a short iron or the like. The golf ball including a core and a cover surrounding the core is characterized in that the cover is constituted by a mixture of an ionomer resin, a thermoplastic elastomer with a rubber segment, and a tackifier having a softening point of not more than 100° C. The peak temperature of the loss tangent is not more than 5° C., and the Shore D hardness is at least 35 and not more than 60.

4 Claims, No Drawings

GOLF BALL

BACKGROUND OF THE INVENTION

1. Field of the Invention

The present invention relates to a golf ball that exhibits great flight distance with favorable shot feeling and that easily comes to a halt even though exhibiting high spin rate when shot from the rough or when shot in a raining condition.

2. Description of the Background Art

Conventional golf balls formed with a thread-wound layer around a liquid center and surrounded by a balata cover are widely used by low-handicapped golfers and professional golfers by virtue of its superior shot feeling and controllability. However, the structure of such golf balls has the disadvantage that the fabrication process is difficult and the cut resistance is inferior. Various soft cover materials are now proposed as a substitute for balata covers.

For example, U.S. Pat. No. 4,884,814 discloses the technique of using soft ionomer resins for the basic resin of the cover. However, the golf ball according to such technique was not satisfactory from the standpoint of spin maintenance since the spin rate in a wet condition was inferior to the spin rate in a dry condition.

Also, the basic resin of a cover disclosed in GB2311530 is formed having as the main component a heated mixture of two components, i.e. ionomer resin, and a styrene-butadiene-styrene block copolymer including a polybutadiene block containing an epoxy group or a styrene-isoprene-styrene block copolymer including a polyisoprene block containing an epoxy group. This publication proposes a golf ball characterized in that the cover composition forming the cover has a flexural modulus of 50–300 MPa and a Shore D hardness of 40–60. The technology provides superior shot feeling and controllability and also favorable flight performance and cut resistance. However, it was not directed to improve the spin maintenance.

U.S. Pat. No. 5,716,293 proposes a golf ball directed to improve the shot feeling and the spin rate when shot with a short iron by virtue of the usage of a solid rubber center including oily substance and a soft cover material.

However, the impact resilience and the shot feeling are not completely satisfactory since oil-resistant rubber or ionomer resin of high hardness is employed for the outer side of the solid rubber center.

The inventor has already proposed a golf ball with a core and a cover surrounding the core, wherein the cover is formed of a mixture including an ionomer resin, a thermoplastic elastomer and a tackifier with a Shore D hardness of 40–65 to improve the spin performance when shot in a wet condition (U.S. Ser. No. 09/662,800). However, the impact resilience was not of a satisfactory level at low temperature.

SUMMARY OF THE INVENTION

In view of the foregoing problems of conventional golf balls, the object of the present invention is to provide a golf ball exhibiting soft feeling with a superior impact resilience even at low temperature, and that can easily come to a halt though the spin rate is great when shot from the rough or when shot in a raining condition.

According to an aspect of a golf ball including a core and a cover surrounding the core of the present invention, the cover is constituted by a mixture of an ionomer resin, a thermoplastic elastomer with a rubber segment, and a tackifier having a softening point of not more than 100° C. The cover exhibits a peak temperature of not more than 5° C. for the loss tangent, and a Shore D hardness of at least 35 and not more than 60.

According to another aspect of the golf ball of the present invention, the tackifier is blended 5–30 parts by weight with respect to the total 100 parts by weight of the ionomer resin and thermoplastic elastomer with a rubber segment constituting the cover.

According to a further aspect of the golf ball of the present invention, the thermoplastic elastomer with a rubber segment includes a styrene-isoprene-butadiene-styrene block copolymer (SIBS structure), a styrene-butadiene-styrene block copolymer (SBS structure), a styrene-ethylene-butylene-styrene block copolymer (SEBS structure) corresponding to the hydrogenated double bonded portion of the butadiene of the SBS structure, a styrene-isoprene-styrene block copolymer (SIS structure), a styrene-ethylene-propylene-styrene block copolymer (SEPS structure) corresponding to the hydrogenated double bonded portion of that isoprene of the SIS structure, a styrene- ethylene- ethylene-propylene-styrene block copolymer (SEEPS structure), and a modified product thereof.

According to still another aspect of the golf ball of the present invention, the tackifier is a terpene resin and/or rosin ester resin.

The foregoing and other objects, features, aspects and advantages of the present invention will become more apparent from the following detailed description of the present invention.

DESCRIPTION OF THE PREFERRED EMBODIMENT

The present invention is directed to a golf ball including a core and a cover surrounding the core.

In the present invention, the ionomer resin employed as the basic resin of the cover is, for example, a binary copolymer of α-olefin and α, β-unsaturated carboxylic acid having 3–8 carbon atoms, obtained by neutralizing at least a portion of the carboxyl group thereof with metallic ions. Alternatively, a ternary copolymer of α-olefin, α, β-unsaturated carboxylic acid having 3–8 carbon atoms, and α, β-unsaturated carboxylic acid ester having 2–22 carbon atoms, obtained by neutralizing at least a portion of the carboxyl group thereof with metallic ions can be employed. As to the composition ratio, 80–90% by weight of α-olefin and 10–20% by weight of α, β-unsaturated carboxylic acid are preferable when the base polymer of the ionomer resin is a binary copolymer of α-olefin and α, β-unsaturated carboxylic acid having 3–8 carbon atoms. When the base polymer is a ternary copolymer of α-olefin, α, β-unsaturated carboxylic acid having 3–8 carbon atoms and α, β-unsaturated carboxylic acid ester having 2–22 carbon atoms, 70–85% by weight of α-olefin, 5–20% by weight of α, β-unsaturated carboxylic acid, and 10–25% by weight of α, β-unsaturated carboxylic acid ester are preferable. It is also preferable that the melt index (MI) of these ionomer resins is 0.1–20, particularly 0.5–15.

As the α-olefin, ethylene, propylene, 1-butene, 1-pentene, for example, are employed, wherein ethylene is particularly preferable. As the α, β-unsaturated carboxylic acid having 3–8 carbon atoms, acrylic acid, methacrylic acid, fumaric acid, maleic acid, crotonic acid, for example, are employed, wherein acrylic acid and methacrylic acid are particularly preferable. As the unsaturated carboxylic acid ester, methyl, ethyl, propyl, n-butyl, isobutyl ester or the like of acrylic acid, methacrylic acid, fumaric acid, maleic acid or the like, for example, are employed, wherein acrylic acid ester and methacrylic acid ester are particularly preferable. As the metallic ion neutralizing at least a portion of the carboxyl group in the foregoing copolymer of α-olefin and α, β-unsaturated carboxylic acid or the foregoing ternary copolymer of α-olefin, α, β-unsaturated carboxylic acid and α, β-unsaturated carboxylic acid ester, sodium ion, lithium ion, zinc ion, magnesium ion, potassium ion, for example, can be enumerated. When the ionomer resin has at least a portion of the carboxyl group in the copolymer of ethylene and acrylic acid or methacrylic acid neutralized with metallic ions, the highly rigid and high flow type having a melt index of 3–7 and a flexural modulus of 200–400 MPa is preferable.

Specific trade names of the ionomer resin are enumerated in the following. Hi-milan 1555 (Na), Hi-milan 1557 (Zn), Hi-milan 1605 (Na), Hi-milan 1706 (Zn), Hi-milan 1707 (Na), Hi-milan AM7318 (Na), Hi-milan 1706 (Zn), Hi-milan AM7315 (Zn), Hi-milan AM7317 (Zn), Hi-milan AM7311 (Mg), and Hi-milan MK7320 (K) sold by Mitsui-DuPont Polychemical Co., Ltd. are available as the binary copolymer ionomer resin. As the ternary copolymer ionomer resin, Hi-milan 1856 (Na), Hi-milan 1855 (Zn), and Hi-milan AM7316 (Zn) are available from Mitsui-DuPont Polychemical Co., Ltd. As ionomer resins sold by DuPont Co., Surlyn 8945 (Na), Surlyn 8940 (Na), Surlyn 8945 (Na), Surlyn 9910 (Zn), Surlyn 9945 (Zn), Surlyn 7930 (Li), and Surlyn 7940 (Li) are available. As the ternary copolymer type ionomer resin, Surlyn AD8265 (Na) and Surlyn AD8269 (Na) are available from DuPont Co.

As ionomer resins available from Exxon Chemical Japan Ltd., Iotek 7010 (Zn), Iotek 8000 (Na) and the like are available. Na, Zn, K, Li, Mg and the like in the above parenthesis following respective trade names of the ionomer resin indicate the metal type of these neutral metallic ions. In the present invention, the ionomer resin employed in the basic resin of the cover may have at least two of those enumerated above mixed. Alternatively, at least two types of the ionomer resin neutralized with monovalent metallic ions enumerated above and ionomer resin neutralized with divalent metallic ions can be mixed to be used.

As the material of the cover of the present invention, at least one type of thermoplastic elastomer with a rubber segment in its polymer unit, (i.e., a thermoplastic elastomer having a soft segment and a hard segment) is used. Here, the thermoplastic elastomer with a rubber segment employs a block copolymer having a block unit by a conjugated diene compound such as a butadiene block or isoprene block as the rubber segment. As the conjugated diene compound, one or at least two types can be selected from, for example, butadiene, isoprene, 1,3-pentadiene, 2,3-dimethyl-1,3-butadiene. Particularly, butadiene, isoprene, and a combination thereof are preferable. As the component forming other block copolymers, one or at least two types can be selected from styrene, α-methyl styrene, vinyl toluene, p-3 butyl styrene, 1,1-diphenyl ethylene, wherein styrene is particularly preferable.

As specific examples of block copolymers, a styrene-isoprene-butadiene-styrene block copolymer (SIBS structure), a styrene-butadiene-styrene block copolymer (SBS structure), a styrene-ethylene-butylene-styrene block copolymer (SEBS structure) corresponding to the hydrogenated double bonded portion of the butadiene of the SBS structure, a styrene-isoprene-styrene block copolymer (SIS structure), a styrene-ethylene-propylene-styrene block copolymer (SEPS structure) corresponding to the hydrogenated double bonded portion of that isoprene of the SIS structure, a styrene- ethylene- ethylene-propylene-styrene block copolymer (SEEPS structure), and a modified product thereof can be enumerated.

The containing amount of styrene (or an alternative monomer) of the foregoing SIBS structure, SBS structure, SEBS structure, SIS structure, SEPS structure, and SEEPS structure is in the range of 10–50% by weight, particularly 15–45% by weight in the copolymer. If the containing amount thereof is less than 10% by weight, the cover will become so soft that the cut resistance is degraded. If the containing amount is greater than 50% by weight, the ionomer resin cannot be softened sufficiently. As a result, the shot feeling and controllability are degraded.

In the present invention, an epoxy group can be included as a part of the copolymer of the foregoing SIBS, SBS, SEBS, SIS, SEPS and SEEPS structures.

For example, the styrene-butadiene-styrene block copolymer (SBS structure) including a polybutadiene block with an epoxy group is a block copolymer having polystyrene at both terminals with an intermediate chain of polybutadiene containing the epoxy group, wherein a portion or all of the double bond of the polybutadiene portion is hydrogenated. The styrene-isoprene-styrene block copolymer having a polyisoprene block containing an epoxy group (SIS structure) is a block copolymer having polystyrene at both terminals with an intermediate chain of polyisoprene containing the epoxy group, wherein a portion or all of the double bond of the polyisoprene portion is hydrogenated.

The containing amount of the epoxy group in the block copolymer of the epoxidized SBS structure or SIS structure is preferably 0.05–10% by weight, particularly 0.2–5% by weight. If the containing amount of the epoxy group is lower than 0.05% by weight, reaction between the epoxy group and the free carboxyl group in the ionomer resin is reduced to degrade the dispersion of the block copolymer of the epoxidized SBS or SIS structure in the ionomer resin. There is a possibility that the durability is degraded. If the containing amount of the epoxy group is larger than 05–10% by weight, reaction between the epoxy group and the free carboxyl group in the ionomer resin becomes excessive to degrade the flowability. There is a possibility that ball-molding becomes difficult.

As products of the block copolymer of the epoxidized SBS or SIS structure available on the market, the styrene-butadiene-styrene block copolymer including a polybutadiene block containing an epoxy group (SBS structure) sold under the trade names of Epofriend A1010 and ESBS from Daicel Chemical Industries Ltd., and the styrene-butadiene-styrene block copolymer corresponding to a hydrogenated portion of a polybutadiene block including an epoxy group sold under the trade name of ESBS AT018 and ESBS AT019 from Daicel Chemical Industries Ltd. can be enumerated. All of these products are suitable in the present invention.

As the block copolymer having the SEBS, SEPS, or SEEPS structure with a hydroxyl group added to one or both of the polymer chain terminals, there is available on the market HG-252 from Kuraray Co., Ltd.

In the present invention, the desired cover characteristics can be obtained by heating and mixing the foregoing ionomer resin with the thermoplastic elastomer of the SBS or SIS structure. The heat-mixing process is carried out at, for example, 150–260° C. using an internal mixer such as the general two-shaft kneading type extruder, Banbury, kneader, or the like.

The tackifier employed in the cover of the present invention has a softening point of not more than 100° C., and coumarone-indene type resins, terpene type resins, rosin derivatives, phenol-formaldehyde type resins, alkyl phenol type resins, petroleum type resins, xylene-formaldehyde type resins, oligomers of polybutene, liquid rubber such as liquid polyisoprene and the like can be used. Particularly, the terpene type resins and rosin ester type resins having a softening point in the range of 30–100° C. are preferably applicable.

The softening point is measured according to JIS-K2207 (ring and ball method). If the softening point exceeds 100° C., it becomes difficult to adjust the peak temperature of the loss tangent (tan δ) of the cover component to below 5° C. The coefficient of restitution at low temperature will be degraded.

The foregoing terpene resin is a polymer of terpene monomer or a polymer thereof with the second comonomer in the polymer chain, which includes the terpene resin whose basic structure is shown by the following general formula (1), styrene based terpene resin whose basic structure is shown by the following general formula (2), phenol modified terpene resin whose basic structure is shown by the following general formula (3), and hydrogenated terpene resin thereof.

Formula (1)

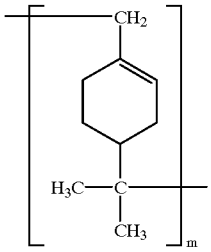

Formula (2)

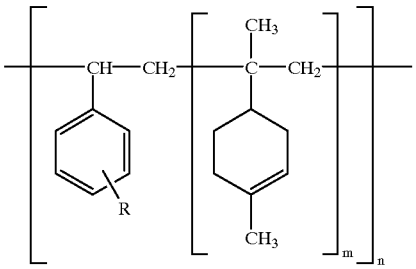

Formula (3)

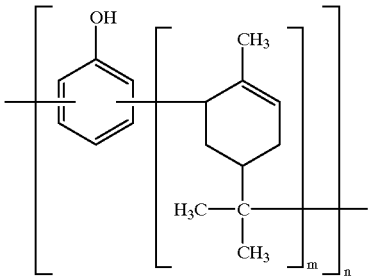

In the above formulas of (1)–(3), m and n are integers.

Specific trade names of such tackifiers are set forth in the following. As the coumarone resin, Process Resin A81, Process Resin AC5, and Process Resin TX from Kobe Oil Chemical Industry Co., Ltd., Coumarone CL from Ouchishinko Chemical Industries Ltd., and coumarone resin NG4 from Nippon Steel Chemical Industries Ltd. are available. As the terpene-phenol resin, Tackirol 101, Tackirol 160, Tackirol EP20, and Tackirol EP30 from Sumitomo Chemical Co., Ltd., and Sumilight resin PR19900 from Sumitomo Dulez Co., Ltd. are available.

As the petroleum based resin, hydrogenated terpene resin Clearon P 85 (softening point :85° C., Tg:28° C.), Clearon P105(softening point :105° C., Tg:48° C.) from Yasuhara Chemical Co., Ltd., Arkon P90 and Ester gum H from Arakawa Chemical Industries Ltd., Petroresin #80 and Hilets G100X from Mitsui Petrochemical Industries Ltd. are available.

As the rosin derivative, Nikanol A70 from Mitsubishi Gas Chemical Co., Inc., Lignol R70 from Libnite, and rosin ester resin from Arakawa Chemical Industries Ltd. are available.

The tackifier having a softening point of not more than 100° C. is dispersed-mixed into the basic resin of the cover to provide appropriate adherence to the cover. Furthermore, the peak temperature of the loss tangent can be shifted to a low temperature of not more than 5° C. As a result, the adherence onto the club face is improved when hitting the golf ball. The spin maintenance and the coefficient of restitution at low temperature are improved.

With respect to the total of 100 parts by weight of the ionomer resin and the thermoplastic elastomer with a rubber segment, 30–90 parts by weight of the ionomer resin and 10–70 parts by weight of the thermoplastic elastomer with a rubber segment are preferably blended. Furthermore, 5–30 parts by weight of the tackifier are preferably blended with respect to the total 100 parts by weight of the ionomer resin and a thermoplastic elastomer with a rubber segment. If the amount of the ionomer resin is too small, the hardness becomes so low that the coefficient of restitution is degraded. If the amount of the ionomer resin is too much, the spin maintenance is reduced. If the amount of the thermoplastic elastomer with a rubber segment is too small, the advantage of the tackifier is not easily exhibited. As a result, the spin maintenance is reduced. If the amount of the thermoplastic elastomer with a rubber segment is too much, the hardness becomes too low.

The cover of the present invention preferably has a peak temperature of the loss tangent (tan δ) at not more than 5° C. Here, the loss tangent is obtained from the temperature variance curve of the dynamic viscoelasticity in the shear mode measured under the conditions of temperature increase rate: 4° C./min.; frequency: 10 Hz; displacement amplitude: 2.5 μm; range of temperature measurement: −100~100° C.; and strain amount: 0.125% defined by the ratio of B/A×100 where A is the thickness of the specimen and B is the shear deformation. As the specimen segment, a square of 5 mm having a thickness of 2 mm was made, and an electroviscosity spectrometer DVE-200 modified type of Shimadzu Corporation was used.

If the peak temperature of the loss tangent exceeds 5° C., the coefficient of restitution at low temperature is degraded. The peak temperature of the loss tangent is preferably not more than 0° C. Appropriate durability, spin performance and impact resilience over the range of low temperature to high temperature are required for the cover. Therefore, the peak temperature of the loss tangent is at least −80° C., preferably at least −50° C., and particularly at least −30° C. The range of the peak temperature is determined by the combination of either the lower limit value and upper limit value. For example, the peak temperature is −80° C.~5° C., preferably −50° C.~0° C., particularly preferably −30° C.~0° C.

The hardness of the cover of the present invention over the core, i.e., the ball cover hardness is 35–60, preferably 38–58, more preferably 40–55 in Shore D hardness. If the Shore D hardness is less than 35, the ball will become so soft that the back spin in a dry condition will increase to lower the initial velocity of the ball. If the hardness exceeds 60, the spin rate when shot using a short iron or the like will be reduced. Here, the Shore D hardness is measured according to ASTMD-2240.

The composition of the cover in the present invention can include, if necessary, in addition to the foregoing resin corresponding to the main component, a filler such as barium sulfate or a pigment such as titanium dioxide, and also other additives such as a dispersion, an antioxidant, an ultraviolet absorber, a photo-stabilizer, a fluorescent material or a fluorescent brightening agent, provided that the blended amount thereof is within the range that does not deteriorate the desired characteristics of the golf ball cover. In general, the blending amount of the pigment is preferably 1.0–6.0 parts by weight.

The present invention is applicable to both golf balls with a solid core or a thread-wound core.

The solid core can be of the type of one layer structure or a multilayer structure of two or more layers. For example, the solid core of a two piece ball is produced by heating and compressing a rubber composition for 10–40 minutes at the temperature of 140–170° C., for example, by press-curing to form into a spherical cured product. The rubber composition is blended with 10–50 parts by weight in total of one or at least two types of a cross-linker formed of α, β-monoethylenic unsaturated carboxylic acid such as acrylic acid or methacrylic acid or metal salt thereof, or a trimethylol propane trimethacrylate polyfunctional monomer, 10–30 parts by weight of a filler such as of zinc oxide or barium sulfate, 0.5–5 parts by weight of a peroxide such as dicumyl peroxide, and, if necessary, 0.1–1 parts by weight of an antioxidant with respect to 100 parts by weight of polybutadiene.

The diameter of the solid core of the present invention is preferably in the range of 36.5–40.7 mm, preferably 38.0–40 mm. The deformation from the initial state of applying an initial load of 10 kg to the state of applying a final load of 130 kg to the core is preferably 0.6–7 mm, further preferably 0.8–3.0 mm.

The thread-wound core is constituted by a center and a rubber thread layer formed by winding rubber thread in an elongated state around the center. The center may be a solid center composed of a vulcanizate of a rubber composition, or a liquid center having water or liquid such as paste sealed in the center cover of vulcanized rubber. For the solid center, the diameter is preferably 28–38 mm and the deformation from the initial state of applying an initial load of 10 kg to the center to the state of applying a final load of 130 kg is preferably 0.5–6.0 mm, further preferably 0.5–5.0 mm, and particularly preferably 0.5–2.5 mm. If the diameter of the solid center is smaller than 28 mm, the shot angle will become so small that the spin rate is increased. As a result, the flight distance cannot be increased. If the diameter of the solid center is greater than 38 mm, the winding process of the rubber thread will end before tension is applied on the rubber thread. Therefore, repulsion of the rubber thread layer cannot be exhibited sufficiently, so that the impact resilience of the ball is degraded. As a result, the flight distance cannot be increased. If the deformation of the solid center is a smaller than 0.5 mm, the center will be too hard for the ball. The hit feeling when the ball is shot will be degraded. If the deformation of the solid center is greater than 6.0 mm, the center will become too soft. The appropriate hardness for the ball cannot be obtained. There is also the possibility that the ball's initial speed is decreased. For a liquid center, the diameter is preferably 26–34 mm. If the diameter of the liquid center is smaller than 26 mm, the shot angle will be reduced and the spin rate increased. As a result, the flight distance cannot be increased. If the diameter of the liquid center is greater than 34 mm, the predetermined ball hardness cannot be obtained. Also, the impact resilience of the ball will be degraded since the rubber thread layer becomes thinner. As a result, the flight distance cannot be increased.

The foregoing rubber thread can be obtained by vulcanizing a rubber composition having an antioxidant, vulcanization accelerator, sulfur and the like blended with natural rubber or blended rubber of natural rubber and synthesized polyisoprene.

The cover of the present invention can be formed by the well-known method. The cover composition is formed in advance into a hemispherical-shaped half shell. Two thereof enclose the core, followed by a molding process with pressure at 130–170° C. for 1–5 minutes. Alternatively, the cover composition can be injection-molded directly on the core to enclose the same. The cover has a thickness of 1.0–3.0 mm, preferably 1.3–2.6 mm. If the thickness thereof is smaller than 1.0 mm, there is a disadvantage that the cover will crack easily when hit repeatedly. If the thickness is greater than 3.0 mm, the shot feeling is deteriorated. Also, pluralities of dimples are formed as necessary on the surface during the cover molding process. For the purpose of improving the aesthetic appearance to raise the commercial value, the golf ball of the present invention is generally applied with paint and stamped with marking to be provided on the market.

The cover of the present invention can be formed of one layer or a plurality of layers.

EXAMPLE

The present invention will be described according to golf balls of Examples 1–4 of the present invention and Comparative Examples 1–4, produced according the following steps of (1) to (3).

(1) Production of Solid Core

Rubber compositions shown in the following Table 1 were prepared. By filling a mold with the prepared rubber composition and applying vulcanization, a solid core of 39.0 mm in diameter was obtained. Vulcanization was effected for 20 minutes at 165° C., as indicated by the vulcanization condition in Table 1. The deformation when a load of 10–130 kg was applied on the obtained solid core (deformation from the state of applying the initial load of 10 kg to the state of applying the final load of 130 kg on the solid core) was 0.9 mm. The blended values of various components in Table 1 correspond to parts by weight.

TABLE 1

| | | |
|---|---|---|
| Solid Core Component | BR11 ※1 | 100 |
| | Zinc Acrylate | 28 |
| | Zinc Oxide | 15 |
| | Barium Sulfate | 20 |
| | Antioxidant ※2 | 0.5 |
| | Dicumyl Perioxide | 1.0 |
| Solid Core Physical Property | Weight (g) | 30.0 |
| | Diameter (mm) | 39.0 |
| | Deformation (mm) (10 kg→130 kg) | 0.9 |

Vulcanization Condition: 165° C. × 20 minutes
※1: High cis-polybutadiene from Japan Synthetic Rubber Co., Ltd. (Containing 96% of cis content, 1,4-cis-polybutadiene)
※2: Trade name NoclacNS-6. Ouchi Shinko Chemical Industries, Co., Ltd. 2,5-di-tertiary, butyl hydroquinone

(2) Preparation of Cover Composition

The blended material of the compositions shown in the following Table 2 were mixed by a two-shaft kneading type extruder to prepare cover compositions in the form of pellets. The blended values in Table 2 correspond to parts by weight. Extrusion was carried out under the condition of the screw diameter of 45 mm, the screw rotating speed of 200 rpm, and the screw L/D=35. The blended compound was heated to 220–260° C. at the position of the die in the extruder.

TABLE 2

| | | Present Invention Example | | | | Comparative Example | | | |
|---|---|---|---|---|---|---|---|---|---|
| | | 1 | 2 | 3 | 4 | 1 | 2 | 3 | 4 |
| Blend | | | | | | | | | |
| Ionomer resin A | Surlyn 8945※1 | 25 | 30 | — | — | 25 | | — | 45 |
| | Surlyn 9945※2 | 25 | 30 | — | — | 25 | | — | 45 |
| | Iotek 7010※3 | — | — | 30 | 35 | — | 30 | 10 | — |
| | Iotek 8000※4 | — | — | 30 | 35 | — | 30 | 10 | — |
| | High-milan 1855※5 | — | — | — | — | — | — | — | — |
| Thermo plastic elastomer B | HG252※6 | 35 | 30 | 40 | 30 | 35 | 40 | 80 | 10 |
| | Epofriend A1010※7 | 15 | 10 | — | — | 15 | — | — | — |
| Tackifier C | Clearon 85※8 | 20 | 15 | 23 | 15 | — | — | 20 | 20 |
| | Clearon P105※9 | — | — | — | — | 20 | 23 | — | — |
| Blend ratio (A/B/C) | | 50/50/20 | 60/40/15 | 60/40/23 | 70/30/15 | 50/50/20 | 60/40/23 | 20/80/20 | 90/10/20 |
| Titanium dioxide | | 2 | 2 | 2 | 2 | 2 | 2 | 2 | 2 |
| Barium sulfate | | 2 | 2 | 2 | 2 | 2 | 2 | 2 | 2 |
| Physical Properties | | | | | | | | | |
| Loss tangent peak temperature (° C.) | | −5 | 0 | −10 | −5 | 20 | 10 | −20 | 30 |
| Cover hardness (Shore D) | | 42 | 46 | 47 | 52 | 42 | 47 | 32 | 60 |
| DRY Spin rate (rpm) | | 6900 | 6700 | 6800 | 6500 | 6900 | 6800 | 7400 | 6300 |
| WET Spin rate (rpm) | | 4000 | 3600 | 3750 | 3300 | 3800 | 3550 | 3700 | 2200 |
| Spin Maintenance (%) | | 58 | 54 | 55 | 51 | 55 | 52 | 50 | 35 |
| Coefficient of restitution at low temperature (Index) | | 100.0 | 100.4 | 100.6 | 101.0 | 98.6 | 99.0 | 98.1 | 100.7 |

※1: DuPont Co., Ltd., sodium ion neutral ethylene-methacrylic acid copolymer based ionomer resin, MI=4.8, flexural modulus=approximately 280MPa ※2: DuPont Co., Ltd., zinc ion neutral ethylene-methacrylic acid copolymer based ionomer resin, MI=5.2, flexural modulus=approximately 220 MPa ※3: Exxon Chemical Japan Ltd., zinc ion neutral ethylene-acrylic acid copolymer based ionomer resin ※4: Exxon Chemical Japan Ltd., sodium ion neutral ethylene-acrylic acid copolymer based ionomer resin ※5: Mitsui-DuPont Polychemical Co., Ltd., zinc ion neutral ethylene-methacrylic acid-isobutyl acrylate ternary copolymer based ionomer resin ※6: Kuraray Co., Ltd., hydrogenated SIBS with hydroxyl group added to the polymer chain terminal (SEEPS-OH), containing styrene 28 wt %, isoprene/butadiene weight ratio 55/45

※7: Daicel Chemical Industries Ltd., epoxidized SBS, epoxy equivalence 950–1050, butadiene/styrene weight ratio 60/40

※8: Yasuhara Chemical Co., Ltd., hydrogenated terpene resin, softening point: 85° C.

※9: Arakawa Chemical Industries Ltd., hydrogenated rosin ester resin, softening point: 105° C.

(3) Production of Golf Ball

A hemispherical half shell was formed from the cover composition of the above (2). The core of the above (1) was enveloped by two of the half shells, and subjected to press-molding for two minutes at 150° C. in a ball mold. The core with a cover had the surface painted to produce golf balls of Examples 1–4 of the present invention and Comparative Examples 1–4 having an outer diameter of 42.8 mm (cover thickness 1.9 mm).

The cover hardness (Shore D hardness), the coefficient of restitution at low temperature, the spin rate and the spin maintenance were assessed for the obtained golf balls. The results are shown in Table 2.

The physical properties of the ball were assessed in the following manner.

(1) Spin Maintenance

A wood SW club was attached to the swing robot of True Temper Co. The golf ball was hit at the head speed of 20 m/second to obtain the spin maintenance, measured by using the sequential photographs of the shot golf ball.

Measurements were carried out under the normal dry condition and under the wet condition in which the ball and the club face were wetted with moisture.

The spin maintenance is defined as the value of spin rate under wet condition/spin rate under dry condition×100.

(2) Coefficient of Restitution at Low Temperature

The golf ball was cooled for 24 hours in an oven of 0° C., and then subjected to measurement. An aluminum cylindrical object of 200 g in weight was made to collide against the ball at the speed of 55 m/s. The speed of the cylindrical object and golf ball after the collision was measured. The coefficient of restitution for each golf ball was calculated based on these measured speeds and weights. The coefficient of restitution is displayed in index with the value of Example 1 as 100.0. A higher index implies a superior coefficient of restitution.

The result of the measurements of the golf balls of Examples 1–4 and Comparative Examples 1–4 are shown in Table 2. It is appreciated that the golf balls of the present invention have a superior coefficient of restitution and spin maintenance than those of the golf balls of the Comparative Examples.

The golf balls of Comparative Examples 1 and 2 have a peak temperature of the loss tangent of the cover that is higher than 5° C., and a low coefficient of restitution (index) at low temperature. However, the spin maintenance is substantially similar to those of the present invention.

The golf ball of Comparative Example 3 has a low cover hardness that is outside the range of the values of the present invention even though a tackifier having a softening point less than 100° C. is blended. Although the spin maintenance is high, the coefficient of restitution (index) is low.

The golf ball of Comparative Example 4 has a significantly low spin maintenance since the peak temperature of the loss tangent (tan δ) of the cover is at the relatively high level of 30° C.

In the golf ball of the present invention having a solid core and a thread-wound core, the cover material is blended of an ionomer resin, a thermoplastic elastomer with a rubber segment, and a tackifier having a softening point of not more than 100° C. The peak temperature of the loss tangent is adjusted to be low. Therefore, the golf ball with a solid core of the present invention is as soft as a conventional thread-wound golf ball. The coefficient of restitution at low temperature is high and the spin rate when shot by a short iron or the like is great. The golf ball can easily come to a halt. Furthermore, the ratio of the spin rate in a wet condition to the spin rate in a dry condition, i.e., the spin maintenance, is improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball including a core and a cover surrounding the core, said cover being constituted by a mixture of an ionomer resin, a thermoplastic elastomer with a rubber segment, and a tackifier having a softening point of not more than 100° C., said cover having a peak temperature of a loss tangent of not more than 5° C., and a Shore D hardness of at least 35 and not more than 60.

2. The golf ball according to claim 1, wherein said tackifier is blended 5–30 parts by weight with respect to the total of 100 parts by weight of said ionomer resin and said thermoplastic elastomer constituting said cover.

3. The golf ball according to claim 1, wherein the thermoplastic elastomer with a rubber segment in its polymer unit includes a styrene-isoprene-butadiene-styrene block copolymer (SIBS structure), a styrene-butadiene-styrene block copolymer (SBS structure), a styrene-ethylene-butylene-styrene block copolymer (SEBS structure), a styrene-isoprene-styrene block copolymer (SIS structure), a styrene-ethylene-propylene-styrene block copolymer (SEPS structure), a styrene-ethylene- ethylene-propylene-styrene block copolymer (SEEPS structure), and a modified product thereof.

4. The golf ball according to claim 1, wherein said tackifier is a terpene resin and/or rosin ester resin.

* * * * *